US006826910B1

(12) United States Patent
Easton

(10) Patent No.: US 6,826,910 B1
(45) Date of Patent: Dec. 7, 2004

(54) EXTREME CHARGER WITH AIR AMPLIFIER

(76) Inventor: Mark Richard Easton, 4011 N. Camino De Lupo, Tucson, AZ (US) 85718

( * ) Notice: Subject to any disclaimer, the term of this patent is extended or adjusted under 35 U.S.C. 154(b) by 77 days.

(21) Appl. No.: 10/058,913

(22) Filed: Jan. 28, 2002

(51) Int. Cl.[7] ..... F02G 1/00
(52) U.S. Cl. ..... 60/597; 123/559.1
(58) Field of Search ..... 60/597, 605.1, 60/606; 123/559.1

(56) References Cited

U.S. PATENT DOCUMENTS 4,106,456 A * 8/1978 Shinoda et al. ..... 123/434
5,064,423 A 11/1991 Lorentz et al.
5,558,069 A * 9/1996 Stay ..... 123/541
5,753,805 A 5/1998 Maloney
5,819,538 A 10/1998 Lawson, Jr.
6,079,378 A 6/2000 Taue et al.
6,109,886 A 8/2000 Schonfeld et al.
6,240,911 B1 * 6/2001 Patrick ..... 123/585
6,327,856 B1 12/2001 Iwauchi et al.

FOREIGN PATENT DOCUMENTS

WO WO 98/32964 * 7/1998

OTHER PUBLICATIONS

Fluidic System Design, Charles A.Belstering ,John Wiley & Sons Inc., USA.
The Analysis and Design of Pneumatic Systems, Blaine W. Andersen, John Wiley & Sons Inc., USA.

* cited by examiner

*Primary Examiner*—Hoang Nguyen
(74) *Attorney, Agent, or Firm*—Hayes Soloway P.C.

(57) ABSTRACT

An internal combustion engine includes air amplifiers to increase airflow. Air amplification with a high-pressure supply provides a practical way to provide large airflow producing higher rear wheel power. When synchronized to the valve openings the efficiency is enhanced while adding to the system complexity. These additions also apply to an engine with a supercharger of turbocharger. When used in the exhaust path the air amplifiers can also help scavenge exhaust gases from the cylinder for added power.

18 Claims, 7 Drawing Sheets

20
7
14
1
22
24
26
15
1
2
6
17
19
3
4
5
Legend
- 17

EXTREME CHARGER WITH AIR AMPLIFIER

BACKGROUND OF THE INVENTION

Superchargers have been used since 1901 using a mechanical pump to increase the air pressure and oxygen to the cylinder for internal combustion. Many variations to the mechanical pump have been designed since then but applying pneumatic air amplification to an internal combustion is a new concept with great potential which also applies with turbocharged or supercharged engines. The invention presented utilizes air amplifier technology to increase the power output of internal combustion engines. This new invention is a low cost version albeit with less power output than a conventional supercharger on a given engine but can also supplement a supercharger. Air amplifiers are used along with high-pressure air supply to increase airflow into the cylinders.

BRIEF DESCRIPTION OF THE PRIOR ART

There are several patents that utilize compressed air injected into engines to enhance performance. Turbocharger enhancements such as the Weick et al U.S. Pat. No. 3,673,796 inject air directly to the manifold on demand. Similar Lorenz et al U.S. Pat. No. 5,064,423 supplies a supercharger by an exhaust driven turbine, which includes an air pump driven by a compressed air tank. Lawson Jr. U.S. Pat. No. 5,819,538 also enhances a turbocharger by recirculating the turbocharged air during injection of the compressed air.

None of these other methods utilize an air amplifier, which have inherent practical advantage. When using compressed air on even moderately sized engines requires a large flow of compressed air. There are physical limitations on the flow rate of compressed air into ambient pressure. Physics dictates the speed of sound is the limit at which air will flow through a nozzle from a pressurized tank. Therefore for a given valve diameter or nozzle there is a limit to the flow rate. It is possible to have larger diameter nozzles but controlling the flow with large valves becomes much less practical. Air amplifiers can produce large flow rates at modest pressure gains and are very reliable. Another advantage is the flexibility of being able to turn off the additional power and there is no loss in fuel economy if required, or power on demand. Using compressed air that is stored at ambient temperature also has the advantage of cooling the intake temperature to reduce chance of detonation at high output power. Simplicity of air amplifiers can also produce lower system cost for moderate performance gains. Since there are no moving parts in the air amplifier they are very reliable as long as the system is properly filtered to avoid clogs.

NARRITIVE DESCRIPTION

When using an air amplifier in the intake path of an internal combustion engine increased performance is available on demand, with the use of a supplemental pressurized air supply. When you apply full throttle the air amplifier turns on (when enabled) giving greater airflow in turn enabling more fuel and resulting with higher power produced. The simplest implementation is achieved with a fuel-injected engine although this would apply to any naturally aspirated engine or a supplement to forced injection, such as with a supercharger or turbocharger. A modified air amplifier (which will be referred to as just air amplifier in the future) is used for optimal airflow utilizing both the Coanda effect and a supersonic nozzle in conjunction.

DETAILED DESCRIPTION

Figure 1:
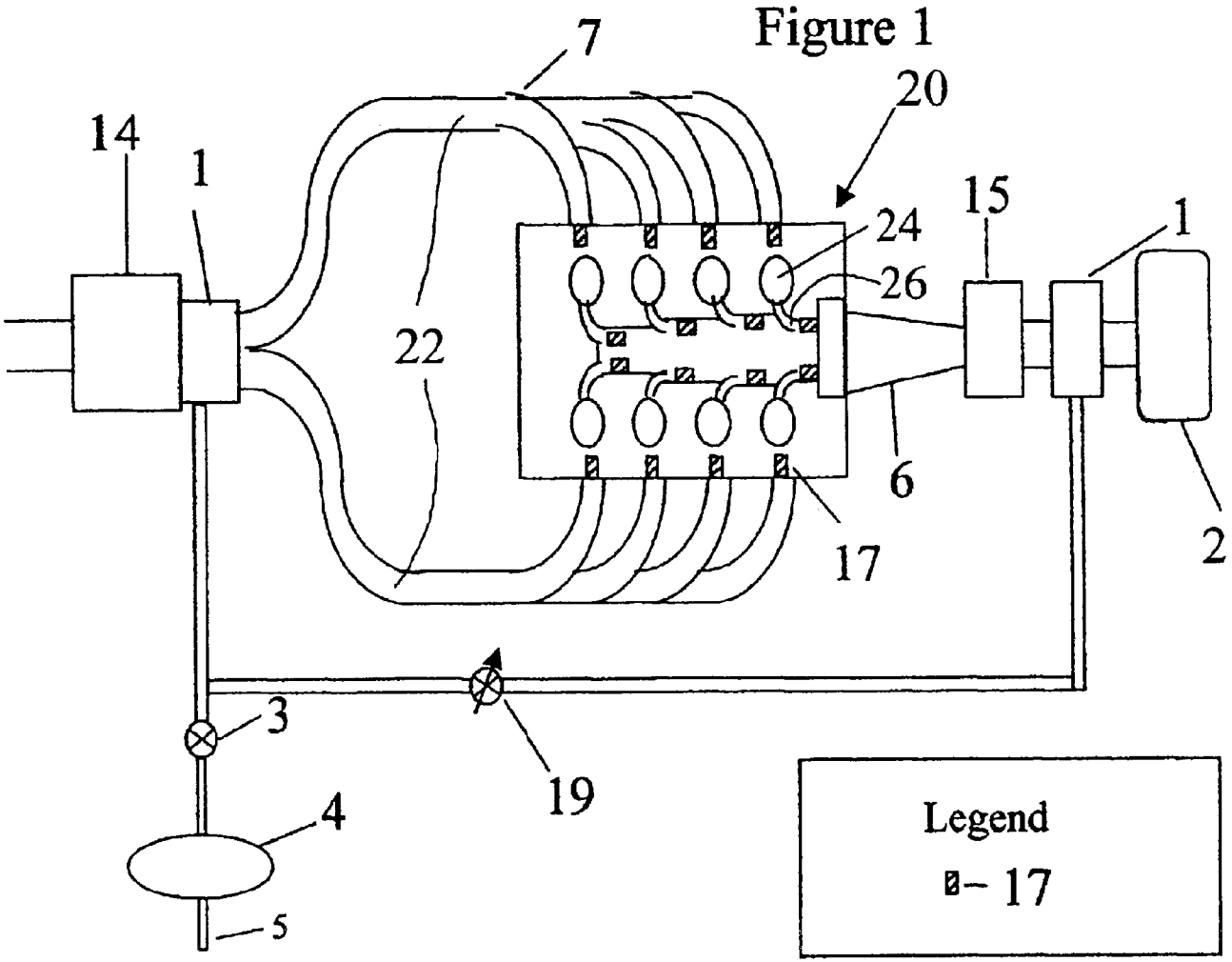
FIG. 1 is a schematic diagram of air amplifiers distributed in a generic engine configuration.

The invention dynamically increases airflow and boosts intake pressure, as more demand is required. FIG. 1 includes air amplifiers distributed throughout the intake exhaust path to increase flow to the cylinder. There are many optional configurations with a minimum of one on either the exhaust or intake path. Items 1 and 17 are standalone and integrated air amplifiers respectively.

The simplest configuration is with one air amp in the exhaust path. The reason that this is more simple is because the control is either full on, or off. The mass airflow sensor will still register the correct reading even at full high pressure flow and low engine RPM. When air amplifiers are in the intake path the high-pressure flow control must account for flow demand and use proportional control. In other words if too much flow is provided to the intake some of that flow will go out the air filter in the wrong direction, therefor amplifier flow control is a must on the intake. If air amplifiers are applied on a per cylinder basis you increase the complexity and efficiency shown as item 17.

Also FIG. 1 shows the devices used in global approach where the air amplifiers are distributed at key areas to increases flow to all cylinders. Item I is an air amplifier that is detailed in FIG. 2. Air enters through air filter 2 and then goes through the first air amplifier 1. The air amplifier is designed so it does not restrict the airflow even when turned off by matching the inside diameter to the system. Any restriction to flow in the intake path may have an air amplifier at that location to yield more flow to the cylinder. As the air travels to the intake manifold an optional supercharger or turbocharger compressor 15 compresses the air. Then the airflow travels through the intake path 6 to the throttle body.

Figure 2:
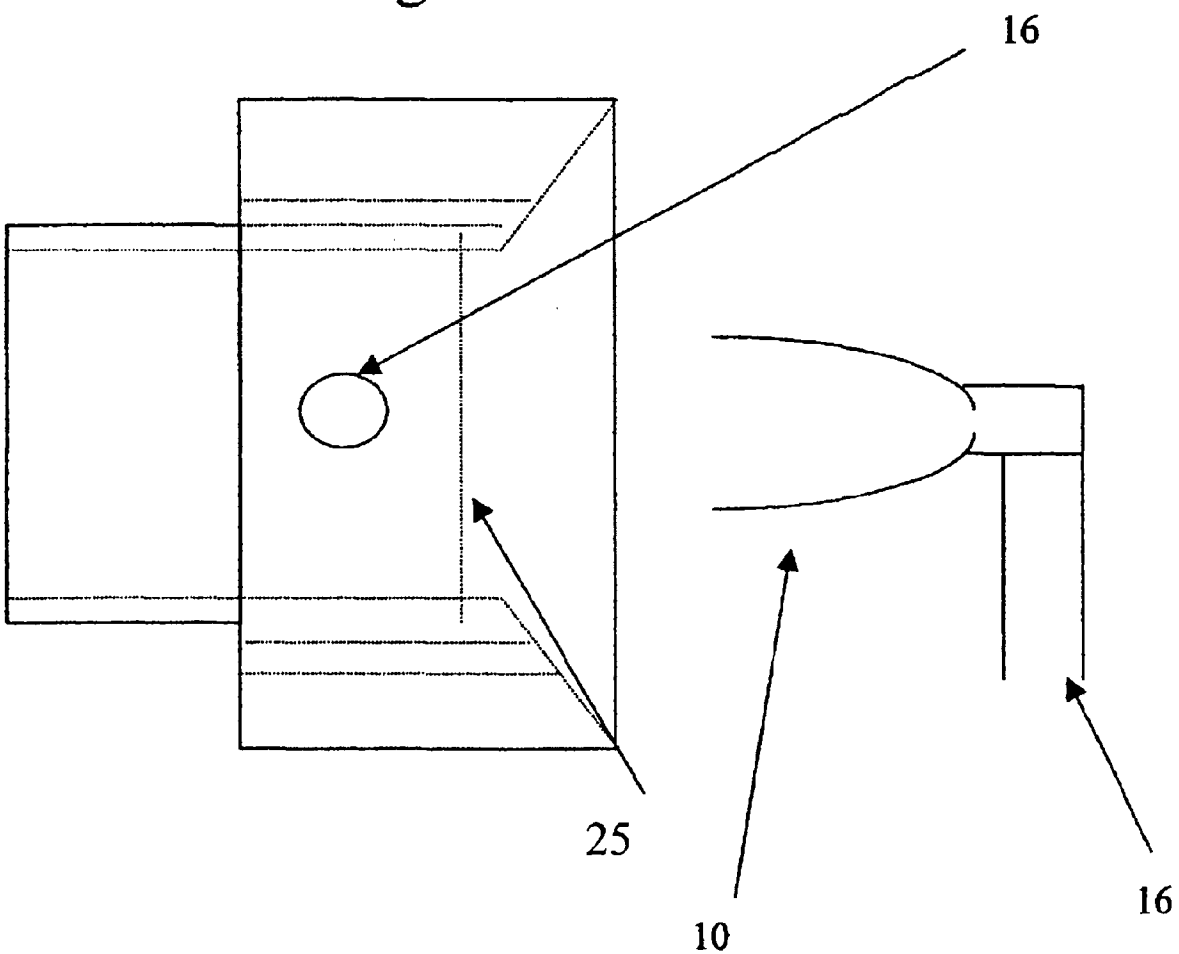
FIG. 2 is an exploded view of an air amplifier component.

FIG. 2 shows more detail of an individual air amplifier. The left nozzle 10 on the main body is a conventional annular opening producing the Coanda effect. In order to maximize flow the nozzle on the right side utilizes conventional supersonic design techniques (utilizing air entrainment). The distance from the annular nozzle (left) to the conventional nozzle (right) edge creates approximately a forty-five degree angle to the centerline.

The maximum performance gains are achieved if integrated air amplifiers 17 are built into the manifold (FIGS. 1, 3, 4 and 5). The variable flow rate valve 19 shows the requirement to control the flow rate to the intake path. This may be implemented with a ball valve with feedback for instance. A sensor or input of engine RPM will also determine the required flow rate. If there is too large of airflow at the mass airflow sensor then turbulence can cause false readings to occur, and air can even flow out of the air filter. Proper placement of the mass airflow sensor downstream of the intake air amplifier is also important for a proper measurement. The control valve 3 is just on or off and does not require adjustable flow due to proper mass airflow sensor readings. The storage tank 4 may also be distributed near the air amplifiers if necessary. The tank pressurization is performed by the tank inlet 5 and may be recharged with an electrical or mechanical pump or just an inlet valve.

Figure 3:
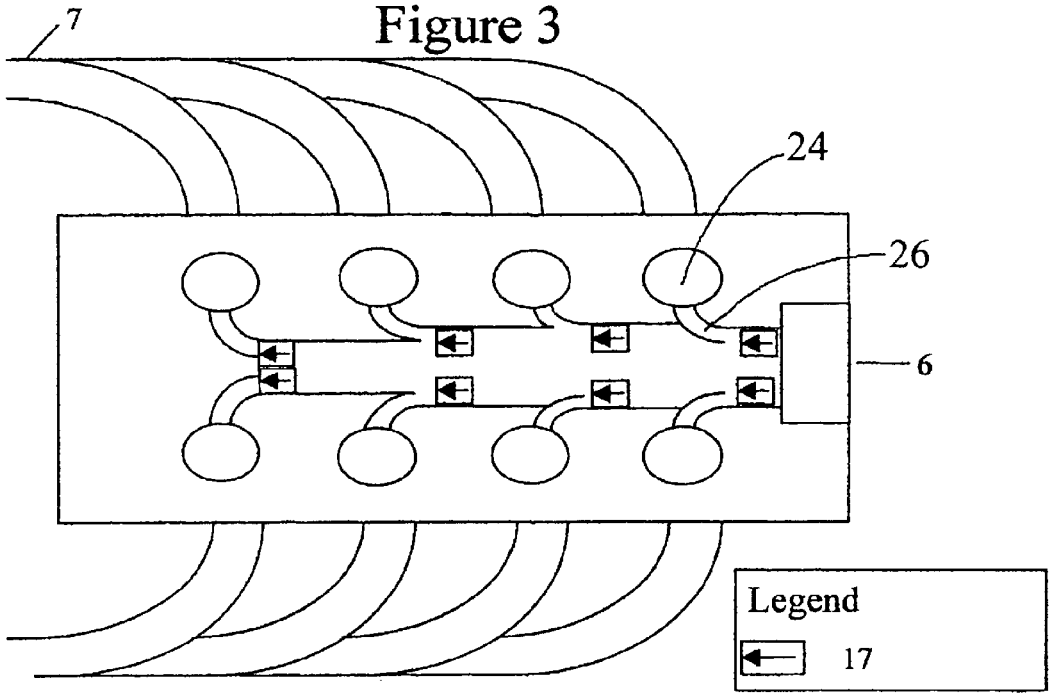
FIG. 3 is a schematic of a portion of engine with integrated air amplifiers in multi-port intake manifold.

The detail of FIG. 3 shows one air amplifier per cylinder and is synchronized to the valve opening with a slight lead time before the opening to account for the transit time. This method could be compared to a multi-port fuel injection system except used with air amplifiers or called multi-port air amplification. In this case one portion of the air amplifier would encircle the valve opening with a beveled edge while the other portion would apply a jet of air which will flow around the edge of the valve when open (FIG. 4).

Figure 4:
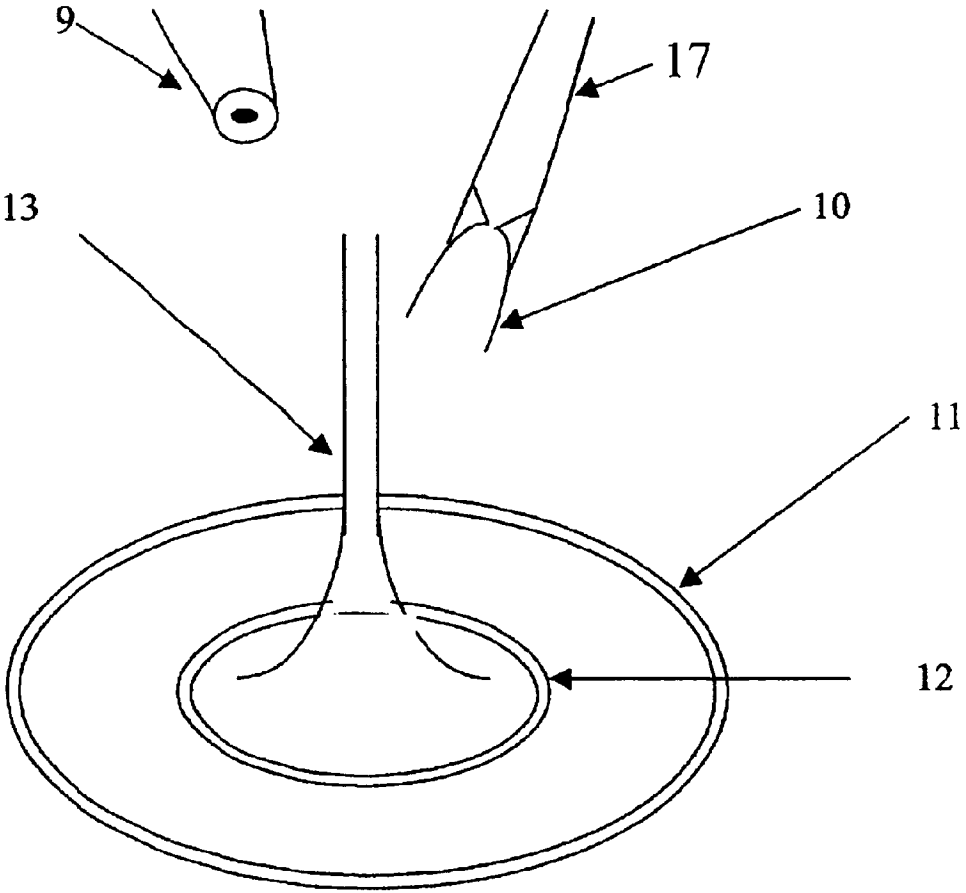
FIG. 4 is an exploded schematic of air amplifiers at intake manifold.

FIG. 4 shows an air amp integrated into an intake valve. The intake port is encircled by the annular high pressure inlet 11 directed in the cylinder direction. Item 12 in FIG. 4 depicts the valve 13 slightly open at the valve seat. A good analogy to how this works is by comparing the airflow to the water flow from a faucet that follows the surface of a spoon when placed in the stream. The jet nozzle 10 adds the flow in the center of the valve inlet while 11 increases flow at the edge.

This method will allow more efficient use of the compressed air while adding complexity. Another consideration in the configuration of FIG. 3 is providing a feedback path for the additional airflow to adjust for the proper air to fuel ratio. The airflow rate can be corrected in several ways such as modification of the mass air flow if sensor output.

Figure 5:
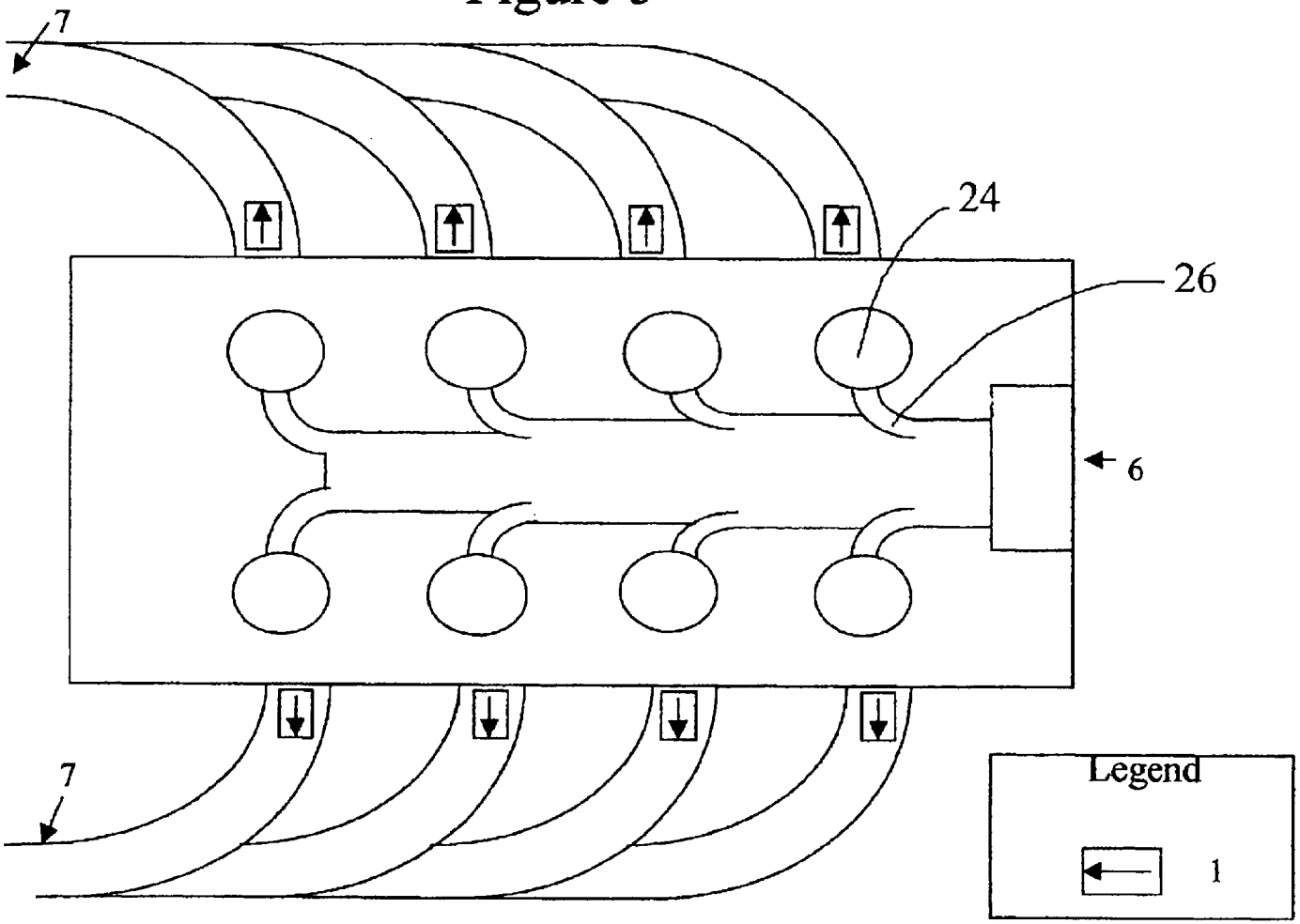
FIG. 5 is a schematic of a portion of engine with air amplifiers in multi-port exhaust manifold.

In high performance applications the air amplifiers also apply to the exhaust ports 7 aimed in the exhaust direction located at the exhaust manifold interface (FIG. 5). Air amplifiers applied to the exhaust path with an amplifier for each cylinder increase the exhaust flow. Another way to view this is the exhaust air amp will help create a vacuum to increase the inlet flow. The pressure differential remains the same but minimum inlet pressure for the air amp is higher due to higher exhaust pressure. This may also increase engine efficiency but more testing is required to be sure. Timing requirements are similar to FIG. 3 in that the control to the air amplifier is synchronized with the valve opening. The control to the air amplifier can be either mechanically or electronically (with solenoid) coupled to the valve opening. One advantage to applying the air amplifier to the exhaust is that the air flow rate does not need to be measured or fed back to the mass air flow input since there is no extra air injected into the intake path.

Figure 6:
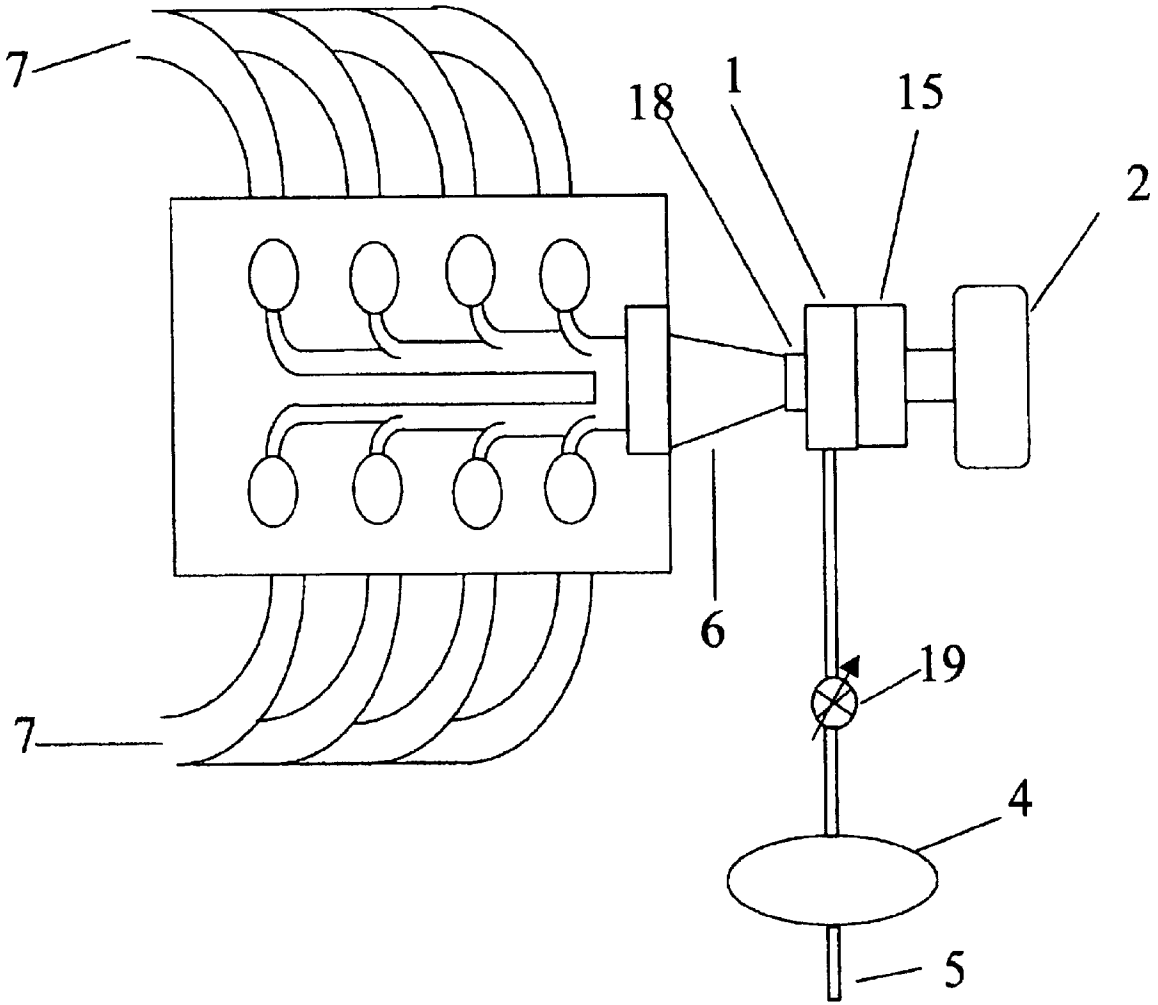
FIG. 6 is a schematic of an alternate implementation of FIG. 1 with supercharger.

FIG. 6 is an alternative arrangement with the air amplifier placed after the super/turbo-charger compressor. In this configuration the mass airflow sensor is placed after the air amplifier to account for the added air supplied. This arrangement also minimizes any delays to desired acceleration but requires a turbo compressor that does not restrict airflow (such as centrifugal type).

Figure 7:
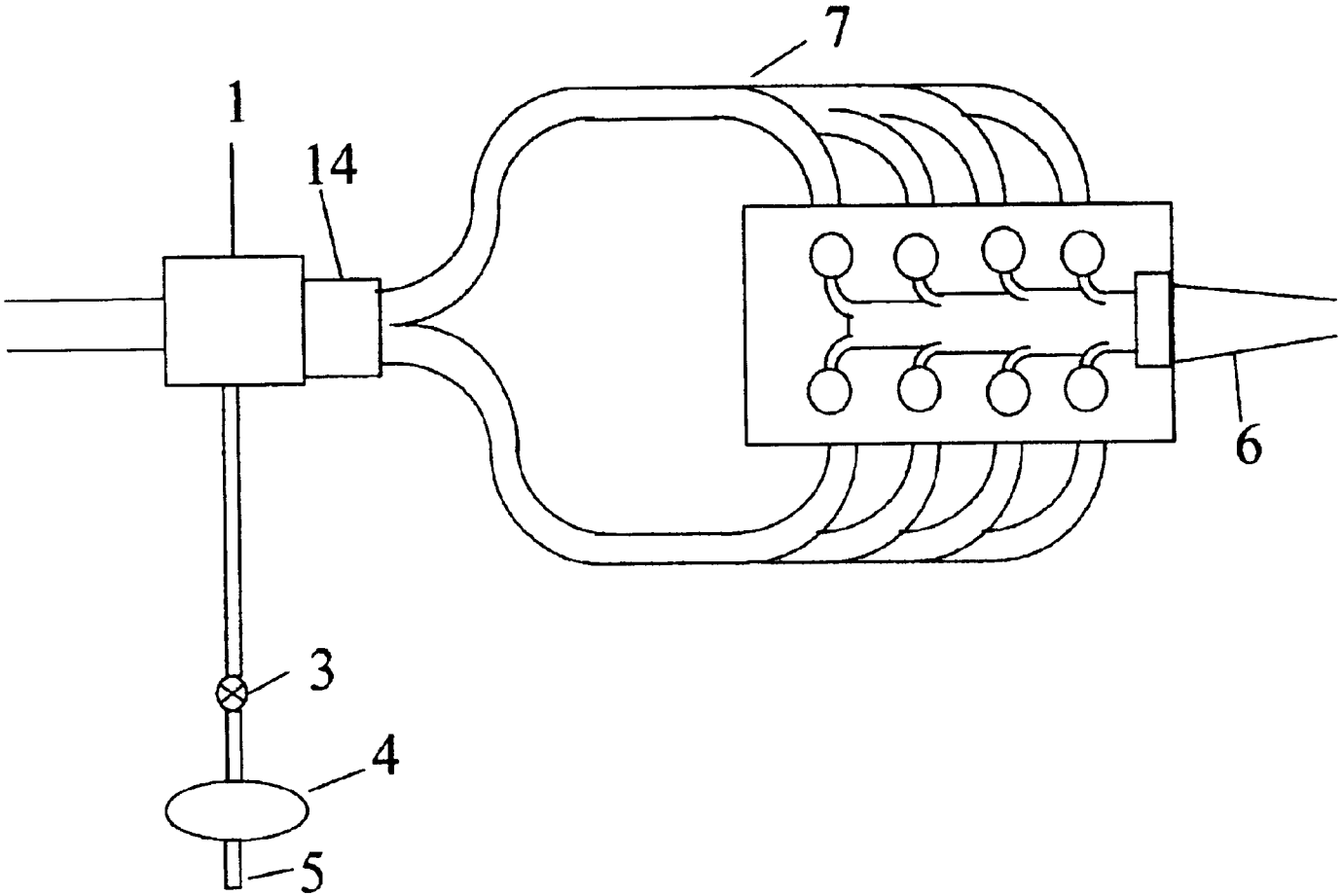
FIG. 7 is a schematic of an alternate implementation of FIG. 1 with turbocharger.

FIG. 7 is an alternate arrangement for better efficiency of the turbocharger turbine 14. This increases the pressure difference across the turbocharger for better efficiency and reduces turbo lag. Another way to view this is that the air amplifier reduces the backpressure for better efficiency of the system. The preferred implementation to minimize turbo lag is to use an air amp on both sides of the turbine, which also adds extra flow going through the turbocharger.

All applications require a robust delivery system with the option of a recharge pump and/or external recharge inlet valve 5. A high-pressure reservoir 4 designed with a safety margin will allow multiple limited uses before recharge. The reservoir system may include several pressurized tanks for proper delivery. In a system with supersonic jets included, the minimum pressure differential requirements are driven by pressure required at the nozzle as prior art has established (approximately 35 PSI at ambient pressure). The use of a conventional air amplifier without a supersonic nozzle is also an option to reduce flow requirements. There are many variations as far as the number of air amplifiers and their placement in the gaseous path of the engine system, the intent being to cover all variations including various number of cylinders. Various modifications and changes may be made to the examples given without deviating from the inventive concepts set forth above.

I claim:

1. A method of controlling air amplifiers on a per-cylinder basis, said method comprising the step of:

synchronizing each of a plurality of air amplifiers to an associated valve and means for proper air-to-fuel ratio;

wherein each said air amplifier comprises:

(a) a pressure vessel providing an auxiliary air supply;

(b) a control valve for operation of pressurized air;

(c) means to control inlet and outlet airflow with additional pressurized inlet; and (d) an air pump and/or inlet to replenish said high pressure tank.

2. A method of providing supplemental flow to an internal combustion engine having an intake path and an exhaust path, said exhaust path being in communication with atmospheric air, said method comprising the steps of:

storing a pressurized fluid in at least one pressure vessel;

disposing, in said exhaust path, an air amplifier coupled to said at least one pressure vessel; and releasing said stored pressurized fluid in the flow direction of said exhaust path via said air amplifier, whereby said stored pressurized air is directed to escape into said atmospheric air.

3. A method as claimed in claim 2, further comprising the steps of:

disposing, in said intake path, an additional air amplifier coupled to said at least one pressure vessel; and releasing said stored pressurized fluid in the flow direction of said intake path via said additional air amplifier.

4. A method as claimed in claim 2, further comprising the step of:

replenishing said at least one pressure vessel by means of a pump and/or inlet.

5. A method as claimed in claim 2, further comprising the step of:

controlling the release of said stored pressurized fluid by means of at least one control valve.

6. A method as claimed in claim 5, further comprising the steps of:

obtaining a measurement by sensing one or more of (a) the number of revolutions per minute of said engine, (b) airflow in at least a portion of said engine, and (c) an air-to-fuel ratio; and operating said control valve based, at least in part, on said obtained measurement.

7. A method of providing supplemental flow to an internal combustion engine having an intake path and an exhaust path, said method comprising the steps of:

storing a pressurized fluid in at least one pressure vessel;

disposing, in said intake path, an air amplifier coupled to said at least one pressure vessel;

obtaining a measurement by sensing one or more of (a) the number of revolutions per minute of said engine, (b) airflow in at least a portion of said engine, and (c) an air-to-fuel ratio; and controlling the release of said stored pressurized fluid in the flow direction of said intake path via said air amplifier based, at least in part, on said obtained measurement.

8. A method as claimed in claim 7, further comprising the step of:

replenishing said at least one pressure vessel by means of a pump and/or inlet.

9. A method for providing supplemental flow to an internal combustion engine having an exhaust path and a plurality of cylinders, each said cylinder having an intake valve and an exhaust port, said method comprising the steps of:

storing a pressurized fluid in at least one pressure vessel;

disposing, directly into the intake valve or directly out of the exhaust port of at least one said cylinder, an air amplifier coupled to said at least one pressure vessel; and releasing said stored pressurized fluid in the flow direction of the exhaust path of said engine via said air amplifier.

10. A method as claimed in claim 9, further comprising the step of:

integrating said air amplifier into said intake valve or exhaust port.

11. A method as claimed in claim 9, further comprising the step of:

replenishing said at least one pressure vessel by means of a pump and/or inlet.

12. A method as claimed in claim 9, further comprising the steps of:

obtaining a measurement by sensing one or more of (a) the number of revolutions per minute of said engine, (b) airflow in at least a portion of said engine, and (c) an air-to-fuel ratio; and controlling the release of said stored pressurized fluid via said air amplifier based, at least in part, on said obtained measurement.

13. A method as claimed in claim 9, further comprising the step of:

controlling the release of said stored pressurized fluid based on the timing of the opening of at least one said intake valve.

14. A method as claimed in claim 9, wherein said internal combustion further has an intake path, and further comprising the steps of:

coupling an additional air amplifier to said at least one pressure vessel;

disposing said additional air amplifier in the intake path or in the exhaust path of said engine; and releasing said stored pressurized fluid in the flow direction of said exhaust path via said additional air amplifier.

15. A method of providing supplemental flow to an internal combustion engine having an intake path and an exhaust path, and having a turbocharger or supercharger disposed in said intake or exhaust path, said turbocharger or supercharger having either an intake path in communication with atmospheric air or an exhaust path in communication with atmospheric air, said method comprising the steps of:

storing a pressurized fluid in at least one pressure vessel;

disposing, in the intake path or exhaust path of said turbocharger or supercharger, an air amplifier coupled to said at least one pressure vessel; and releasing said stored pressurized fluid either (a) in the intake path of said turbocharger or supercharger via said air amplifier in the same flow direction as that of said atmospheric air entering said intake path, or (b) in the exhaust path of said turbocharger or supercharger via said air amplifier in a flow direction such that said stored pressurized air is directed to escape into said atmospheric air, and such that none of said stored pressurized air is fed back into said intake path.

16. A method as claimed in claim 15, further comprising the step of:

replenishing said at least one pressure vessel by means of a pump and/or inlet.

17. A method as claimed in claim 15, further comprising the step of:

controlling the release of said stored pressurized fluid by means of at least one control valve.

18. A method as claimed in claim 17, further comprising the steps of:

obtaining a measurement by sensing one or more of (a) the number of revolutions per minute of said engine, (b) airflow in at least a portion of said engine, and (c) an air-to-fuel ratio; and operating said control valve based, at least in part, on said obtained measurement.

* * * * *